US012075837B1

(12) United States Patent
He

(10) Patent No.: US 12,075,837 B1
(45) Date of Patent: Sep. 3, 2024

(54) ELECTRONIC CIGARETTE HAVING A MOVABLE PART EMBEDDED WITH A PLURALITY OF MAGNETS

(71) Applicant: PAX Innovations (Shenzhen) Limited, Shenzhen (CN)

(72) Inventor: Wei He, Shenzhen (CN)

( * ) Notice: Subject to any disclaimer, the term of this patent is extended or adjusted under 35 U.S.C. 154(b) by 0 days.

(21) Appl. No.: 18/583,204

(22) Filed: Feb. 21, 2024

(30) Foreign Application Priority Data

Jan. 31, 2024 (CN) ..... 202420256443.6

(51) Int. Cl.
*A24F 40/50* (2020.01)
*A24F 40/10* (2020.01)
*A24F 40/40* (2020.01)

(52) U.S. Cl.
CPC ..... *A24F 40/50* (2020.01); *A24F 40/10* (2020.01); *A24F 40/40* (2020.01)

(58) Field of Classification Search
CPC ..... A24F 40/50; A24F 40/10; A24F 40/40
See application file for complete search history.

(56) References Cited

U.S. PATENT DOCUMENTS 11,596,779 B2 * 3/2023 Tong ..... A61M 35/10
2021/0196935 A1 * 7/2021 Tong ..... A61M 35/10
2024/0001095 A1 * 1/2024 Tong ..... A61M 35/10

FOREIGN PATENT DOCUMENTS

EP 3692827 A1 * 8/2020 ..... A24F 40/30
WO WO-2023219425 A1 * 11/2023

* cited by examiner

*Primary Examiner* — Hae Moon Hyeon

(57) ABSTRACT

An electronic cigarette includes a main body, a control module, atomizers, a functional module, a sensing module, and a movable part being capable of sliding or rotating on the main body. The functional module includes at least one of a lighting module, driving modules and a reminder module. The lighting module, the driving modules and the reminder module are all electrically connected to the control module. The atomizers are electrically connected to the control module through the driving modules. The sensing module is used for feeding back a control signal to the control module when the movable part slides or rotates. According to the control signal fed back by the sensing module, the control module switches the functional module, adjusts power output by the driving modules to the atomizers, switches a lighting effect of the lighting module, or switches a working mode of the reminder module.

20 Claims, 7 Drawing Sheets

ELECTRONIC CIGARETTE HAVING A MOVABLE PART EMBEDDED WITH A PLURALITY OF MAGNETS

CROSS-REFERENCE TO RELATED APPLICATIONS

The application claims priority of Chinese patent application CN202420256443.6, filed on Jan. 31, 2024, which is incorporated herein by reference in its entireties.

TECHNICAL FIELD

The present invention relates to a technical field of electronic products, in particular to an electronic cigarette.

BACKGROUND ART

An electronic cigarette is a device that uses atomizers to heat and atomize tobacco liquid to form smoke, and with smoking of a user, an effect of "blowing a cloud" is achieved. For convenience of the user, the electronic cigarette on the market will display a reminder when an electrical quantity of a battery is low, so that the user can charge the electronic cigarette in a timely manner. Besides, a smoke size adjustment is also available. In addition, to make people feel that the product is cool, a lighting effect or other electrical function such as vibration reminder or audio reminder are also added to the electronic cigarette. However, currently, the existing electronic cigarette generally uses buttons to adjust the size of the smoke or turn on a light, and operability of the buttons is poor, which cannot meet the user's needs.

SUMMARY

A main purpose of the present invention is to provide an electronic cigarette for solving a problem of poor operability caused by using buttons to adjust smoke size and switch lighting display effect in existing electronic cigarette.

In order to solve the above-mentioned technical problem, a technical solution is provided by the present invention.

An electronic cigarette includes: a main body; a control module provided on the main body; atomizers electrically connected to the control module; a functional module electrically connected to the control module, wherein the functional module includes at least one of a lighting module, driving modules and a reminder module, the lighting module, the driving modules and the reminder module are all electrically connected to the control module, and the atomizers are electrically connected to the control module through the driving modules; a movable part being capable of sliding or rotating on the main body; and a sensing module electrically connected to the control module.

The sensing module is used for feeding back a control signal to the control module when the movable part slides or rotates. According to the control signal fed back by the sensing module, the control module switches the functional module, adjusts power output by the driving modules to the atomizers, switches a lighting effect of the lighting module, or switches a working mode of the reminder module.

Furthermore, the sensing module includes first magnets, second magnets, and a Hall sensor. The first magnets are provided on the movable part, and the second magnets are provided on the main body corresponding to or near a position of the Hall sensor. The Hall sensor is electrically connected to the control module. The first magnets move when the movable part slides, and when the first magnets move to the position opposite to the second magnets, the first magnets cooperate with the second magnets to generate a magnetic field. The Hall sensor conducts under an action of the magnetic field and feeds back the control signal to the control module.

Furthermore, a total number of the first magnets is multiple, and at least two first magnets are arranged along a lengthwise direction of the main body. The main body is further provided with a plurality of third magnets. At least one of the first magnets is attracted with the second magnets when the movable part is close to the Hall sensor, and at least one of the first magnets is attracted with the third magnets when the movable part is away from the Hall sensor.

Furthermore, the movable part has substantially rectangular plate shape, a total number of the first magnets is four, and the first magnets are arranged at four end corners of the movable part.

A total number of the second magnets is two, and the two second magnets are respectively located on both sides of the Hall sensor and are close to the Hall sensor. The two first magnets adjacent to the Hall sensor are respectively attracted with the two second magnets when the movable part is close to the Hall sensor.

A total number of the third magnets is four, and the third magnets are arranged in a same distribution manner as the four first magnets and are all located above the second magnets. The four first magnets are respectively attracted with the four third magnets when the movable part is away from the Hall sensor.

Furthermore, the electronic cigarette further includes a storage bin provided within the main body for storing tobacco liquid, and the atomizers are provided at a bottom of the storage bin.

Furthermore, a total number of the atomizers is two, and the two atomizers are spaced apart. A total number of the driving modules is two, and each driving module is connected to a corresponding atomizer.

Furthermore, the control module is used for stopping outputting power to one atomizer when the atomizer is driven to work for more than a preset time, and simultaneously driving another atomizer to work.

Furthermore, the control module is further used for driving two atomizers to work simultaneously.

Furthermore, the electronic cigarette further includes a battery located within the main body, and the battery is electrically connected to the control module and used for supplying power to the control module. The battery is located below the storage bin.

Furthermore, a ratio between a capacity of the battery and the capacity of the tobacco liquid is less than or equal to 200 mA/1 ml.

Furthermore, the battery is a disposable battery or a rechargeable battery.

Furthermore, the electronic cigarette further includes a display arranged on the main body and electrically connected to the control module. The display is used for displaying at least one of an electrical quantity of the battery and a state of the functional module, and the display is located below the storage bin.

Furthermore, the electronic cigarette further includes a circuit board arranged within the main body. The control module is integrated on the circuit board. The circuit board is located below the storage bin, and the battery is located on a side of the circuit board away from the display.

Furthermore, the reminder module is located within the main body, and the control module is configured for driving the reminder module when an electrical quantity of the battery is low, the functional module is switched, power output by the driving modules to the atomizers is adjusted, or a lighting effect of the lighting module is switched.

Furthermore, the reminder module includes an audio module. The audio module includes a speaker electrically connected to the control module. The audio module is located inside the main body and on a side of the circuit board away from the battery.

Furthermore, the reminder module includes a vibration module. The vibration module includes a vibration motor electrically connected to the control module. The vibration motor is located inside the main body and on one side of the circuit board away from the battery.

Furthermore, the storage bin is equipped with oil absorbing cotton for storing tobacco liquid.

Furthermore, the electronic cigarette further includes a mouthpiece located at a top of the main body. The top of the main body is provided with a smoke outlet hole and the smoke outlet hole is in communication with an interior of the main body. A smoke guiding hole in communication with the smoke outlet hole is provided on the mouthpiece.

An opening is defined at a top of the storage bin, and a sealant member is provided between the top of the storage bin and an internal top surface of the main body. The sealant member is provided with a through hole, and the through hole is in communication with the storage bin and the smoke outlet hole.

Furthermore, the main body includes a bottom shell with a cavity and a front shell connected to the bottom shell to form the cavity. The circuit board, the battery, the storage bin, the sealant member, the atomizers, and the display are all arranged in the cavity, and the mouthpiece is located on the bottom shell.

The front shell is provided with first embedding slots and second embedding slots on one side near the cavity. The second magnets are placed in the first embedding slots, and the third magnets are placed in the second embedding slots.

The front shell is provided with a sliding groove on one side away from the cavity, and the movable part is placed inside the sliding groove. The first magnets are embedded in the movable part on one side close to the cavity.

Furthermore, the lighting module includes light emitting elements. The light emitting elements are arranged on the circuit board and electrically connected to the control module. A total number of the light emitting elements is two, and the light emitting elements are located on both sides of the display.

Compared with existing technologies, the present invention can improve user operability of function switching by sliding or rotating the movable part on the main body and realizing function switching when sliding or rotating. Moreover, achieving function switching by sliding or rotating to can also provide the user with a playful effect and play a role of relieving stress.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
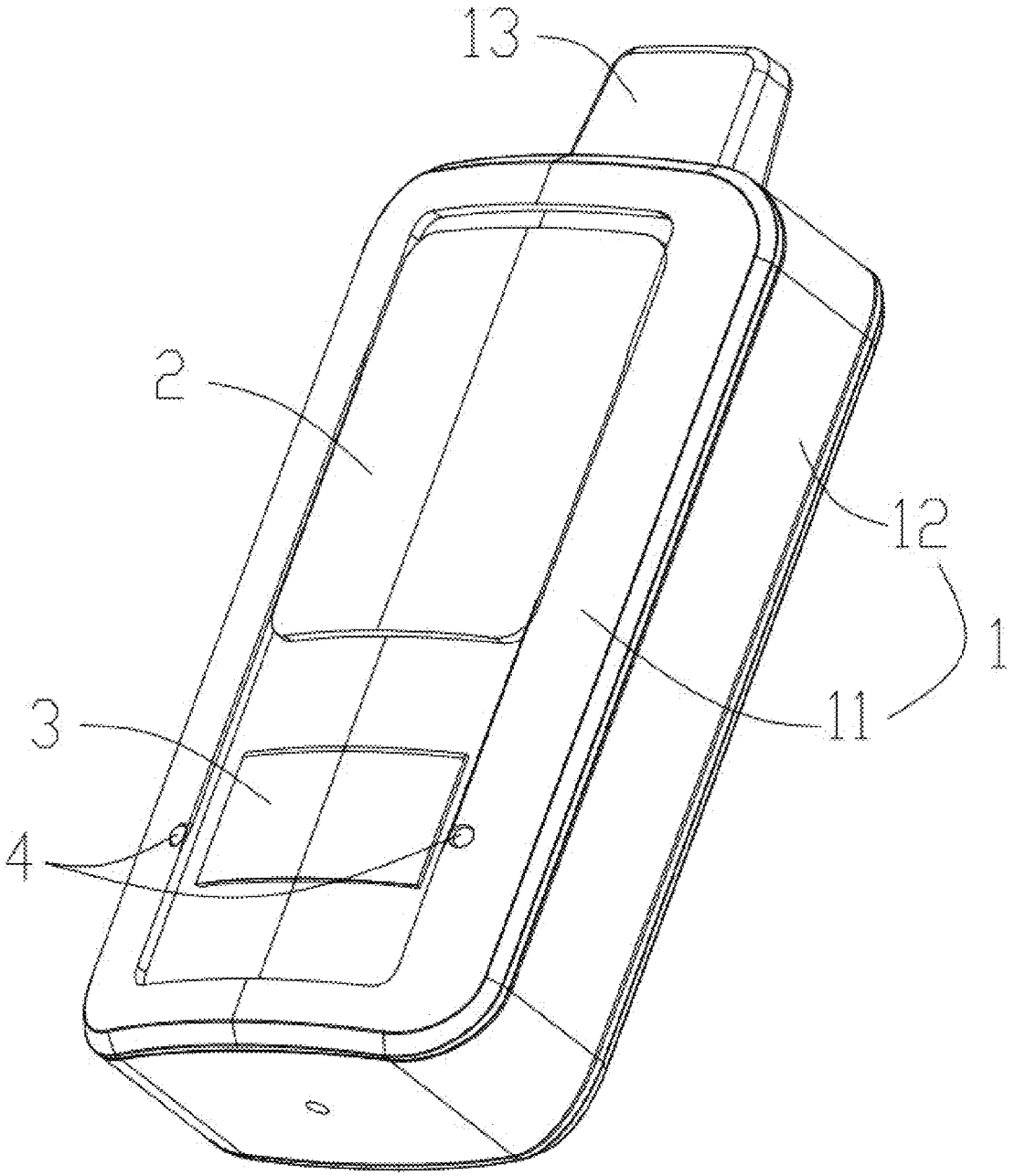
FIG. 1 is a perspective view according to the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

FIGS. 1-6 show an electronic cigarette in an embodiment of the present invention.

Figure 2:
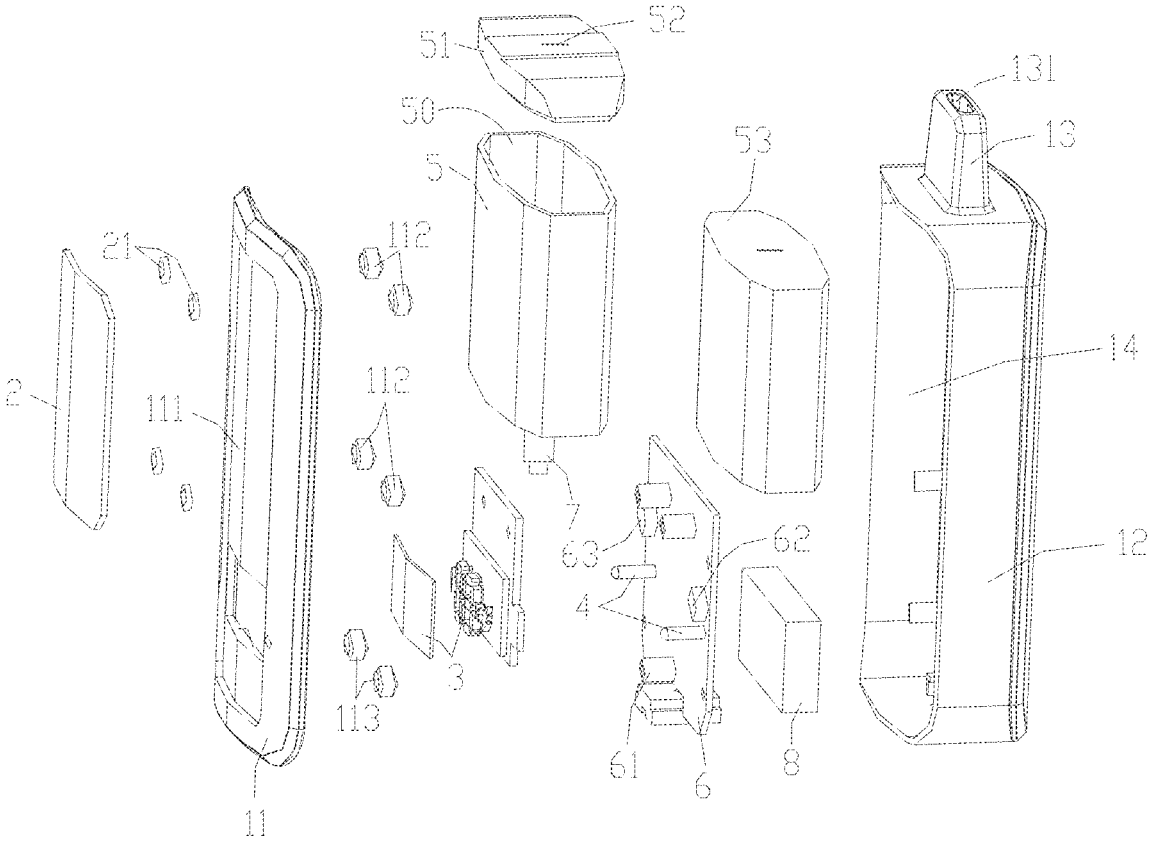
FIG. 2 is an exploded view according to the present invention.
Figure 6:
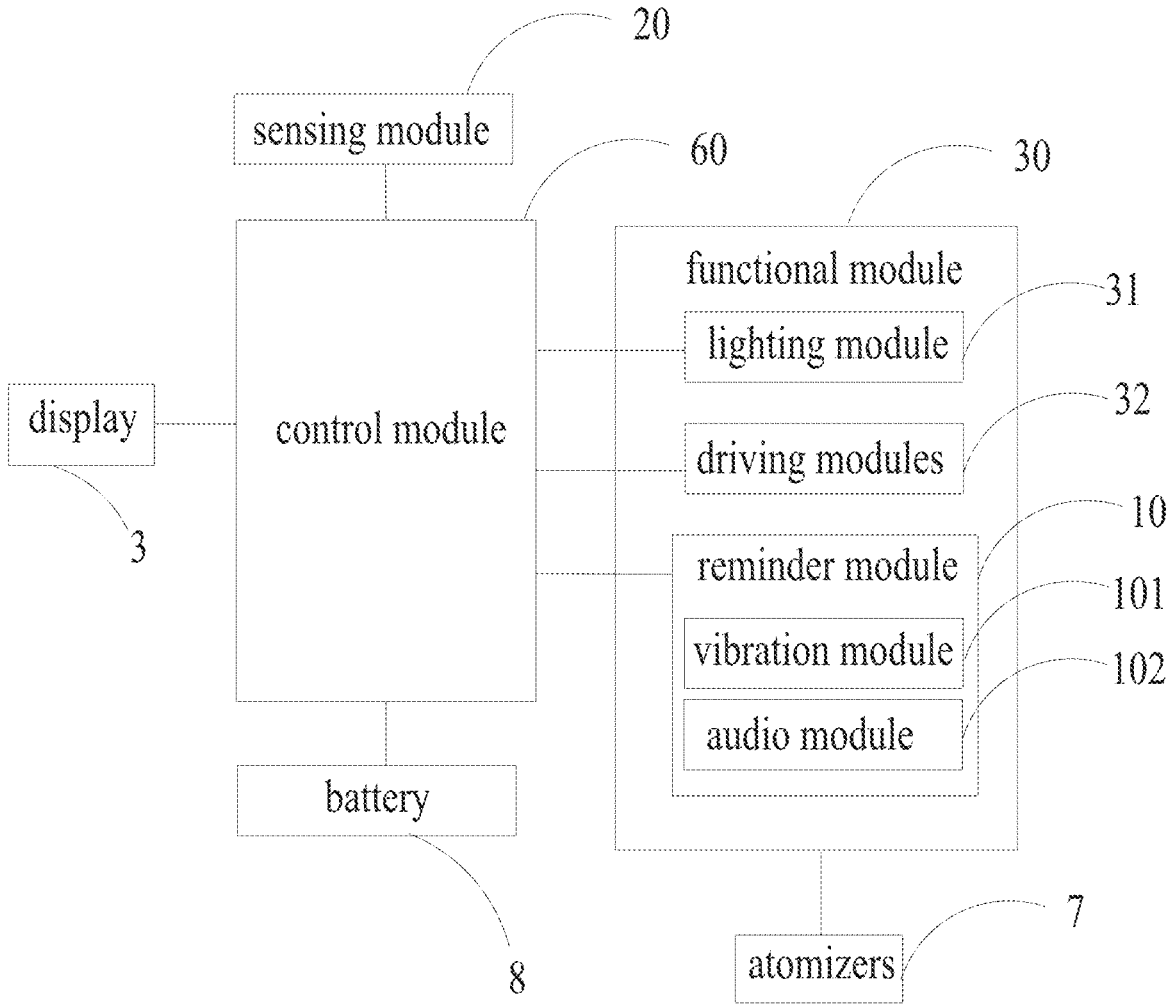
FIG. 6 is a principle block diagram according to the present invention.

Referring to FIGS. 1-2 and FIG. 6, the electronic cigarette includes: a main body 1, a control module 60 provided in the main body 1, atomizers 7 electrically connected to the control module 60, a functional module 30, a sensing module 20, and a movable part 2 being capable of sliding or rotating on the main body 1. The functional module 30 includes at least one of a reminder module 10, a lighting module 31 and driving modules 32. The lighting module 31 and the driving modules 32 are both electrically connected to the control module 60. The atomizers 7 are electrically connected to the control module 60 through the driving modules 32. The sensing module 20 is used for feeding back a control signal to the control module 60 when the movable part 2 slides or rotates. According to the control signal fed back by the sensing module 20, the control module 60 switches the functional module 30, adjusts power output by the driving modules 32 to the atomizers 7, switches a lighting effect of the lighting module 31, or switches a working mode of the reminder module 10.

In this embodiment, the movable part 2 is capable of sliding or rotating on the main body 1, and when the movable part 2 slides, function switching is realized, power output by the driving modules 32 to the atomizers 7 is adjusted, or a lighting effect of the lighting module 31 is adjusted, so that user operability of function switching is improved. Achieving function switching by sliding or rotating can also provide a user with a playful effect and play a role of relieving stress.

In practical application, the sensing module 20 includes a DIP (Dual Inline Package) switch electrically connected to the control module 60, and the movable part 2 is connected to an operating member on the DIP switch. When the movable part 2 slides, the DIP switch is closed and the control signal is fed back to the control module 60, so as to achieve switching function. In other embodiments, the sensing module 20 includes a knob component electrically connected to the control module 60, and the movable part 2 is connected to a knob on the knob component, which can also achieve switching function. Here, there is no limitation on whether the movable part 2 slides or rotates along a certain axis.

In other embodiments, referring to FIG. 2, the sensing module 20 includes first magnets 21, second magnets 113, and a Hall sensor 61. The first magnets 21 are provided on the movable part 2. The second magnets 113 are provided on the main body 1 corresponding to or near a position of the Hall sensor 61. The Hall sensor 61 is electrically connected to the control module 60. The first magnets 21 move when the movable part 2 slides, and when the first magnets 21 move to the position opposite to the second magnets 113, the first magnets 21 cooperates with the second magnets 113 to generate a magnetic field. The Hall sensor 61 conducts under an action of the magnetic field and feeds back the control signal to the control module 60. The control module 60 drives a corresponding functional module 30 based on the control signal to achieve an effect of switching through sliding.

Specifically, in one embodiment, referring to FIG. 2, a total number of the first magnets 21 is multiple, and at least two first magnets 21 are arranged along a lengthwise direction of the main body 1. The main body 1 is further provided with a plurality of third magnets 112. At least one of the first magnets 21 is attracted with the second magnets 113 when the movable part 2 is close to the Hall sensor 61, and at least one of the first magnets 21 is attracted with the third magnets 112 when the movable part 2 is away from the Hall sensor 61. By configuring the third magnets 112, the movable part 2 can be limited by the third magnets 112 when away from the Hall sensor 61, playing a limiting role in a travel of the movable part 2.

In an optimal embodiment, the movable part 2 has substantially rectangular plate shape, a total number of the first magnets 21 is four, and the first magnets 21 are arranged at four end corners of the movable part 2. A total number of the second magnets 113 is two, and the two second magnets 113 are respectively located on both sides of the Hall sensor 61 and are close to the Hall sensor 61. A total number of the third magnets 112 is four, and the third magnets 112 are set in a same distribution manner as the four first magnets 21 and are all located above the second magnets 113. The four first magnets 21 are respectively attracted with the four third magnets 112 when the movable part 2 moves away from the Hall sensor 61. When the movable part 2 slides closer to the Hall sensor 61, the two first magnets 21 adjacent to the Hall sensor 61 are respectively attracted with the two second magnets 113, and the two first magnets 21 located at a top of the movable part 2 are attracted with the two third magnets 112 located below. When the movable part 2 slides away from the Hall sensor 61, the four first magnets 21 can be attracted with the four third magnets 112. Through this configuration, stability of the sliding of the movable part 2 can be improved, tactile sensation of the sliding of the movable part 2 can be improved, and the user's operational comfort can be improved to better relieve pressure.

In the above embodiments, a total number of the Hall sensor 61 is one. When the user slides the movable part 2 close to the Hall sensor 61, switching of specific functions can be realized. In one embodiment, the switching of functions can be two types. When the power output by the driving modules 32 to the atomizers 7 is limited to two types, that is, when the movable part 2 is far away from the Hall sensor 61, the control module 60 controls the power output by the driving modules 32 to the atomizers 7 to be one power, and this power corresponds to a lighting effect. When the movable part 2 is close to the Hall sensor 61, the control module 60 controls the power output by the driving modules 32 to the atomizers 7 to be another power. Therefore, when the user slides the movable part 2, a size of smoke output can be adjusted and the lighting effect can be switched. In other embodiments, a total number of the switching of functions can be three, four, five, etc., that is, when the user slides the movable part 2, the control module 60 can realize the switching of a corresponding function based on a total number of times the Hall sensor 61 conducts.

In the above embodiments, the electronic cigarette further includes a storage bin 5 located within the main body 1 and used for storing tobacco liquid. The atomizers 7 are located at a bottom of the storage bin 5, so that when the control module 60 drives the atomizers 7, a heating wire inside the atomizers 7 will atomize the tobacco liquid to produce a smoke effect.

Figure 7:
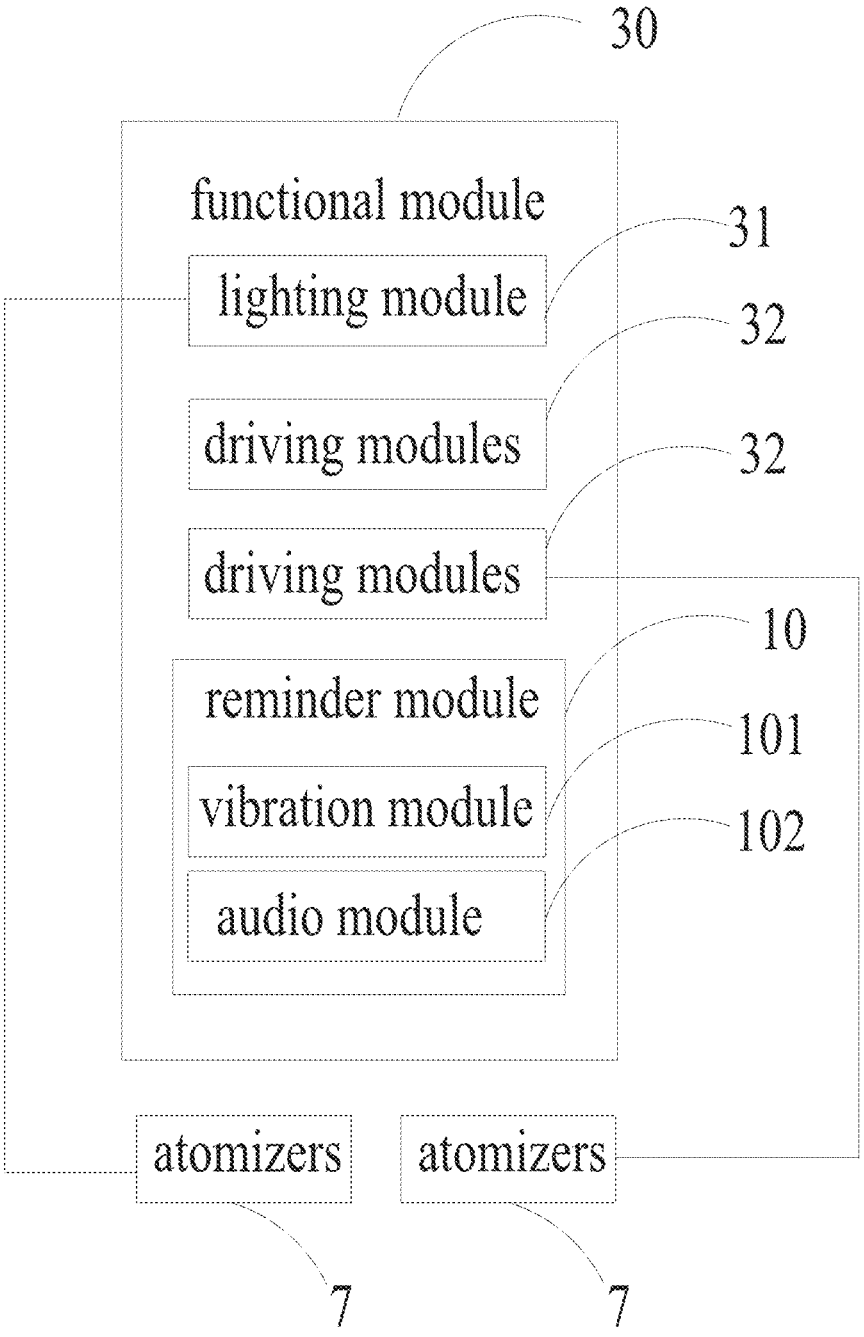
FIG. 7 is another principle block diagram according to the present invention.

In existing technology, the atomizers 7 only work when the user inhales. When the user smokes for too long in one breath, the heating wire inside the atomizers 7 heats up for too long, causing carbon deposits on the heating wire, and the carbon deposits will affect a taste of subsequent smoke. Therefore, in one embodiment, referring to FIG. 7, a total number of the atomizers 7 is two, and these two atomizers 7 are spaced apart. A total number of the driving modules 32 is two, and each driving module 32 is connected to a corresponding atomizer 7. The control module 60 is used for stopping outputting power to one atomizer 7 when the atomizer 7 is driven to work for more than a preset time, and simultaneously driving another atomizer 7 to work. In this way, one atomizer 7 can be prevented from working for too long, thereby maintaining the taste of smoke, and also improving a service life of the atomizers 7.

Of course, in other embodiments, the control module 60 is also used for driving two atomizers 7 to work simultaneously to increase smoke output. In conjunction with the movable part 2, the control module 60 is also capable of operating the movable part 2 to drive two atomizers 7 to work simultaneously when the user needs to increase the smoke output. When it is necessary to reduce the smoke output, the control module 60 is also capable of driving only one atomizer 7 when the user operates the movable part 2.

Of course, in other embodiments, a total number of the atomizers 7 can also be one, three, etc., and the total number of the atomizers 7 is not limited here.

In the above embodiments, the electronic cigarette further includes a battery 8 located within the main body 1. The battery 8 is electrically connected to the control module 60 and is used for supplying power to the control module 60. The battery 8 is located below the storage bin 5. The electronic cigarette further includes a display 3 located on the main body 1 and electrically connected to the control module 60. The control module 60 is further used for detecting an electrical quantity of the battery 8, and the electrical quantity is displayed through the display 3. The display 3 is also used for displaying at least one state of the functional module 30. The display 3 is located below the storage bin 5 and in front of the battery 8. By using the display 3 to display the electrical quantity of the battery 8, the user can easily understand the electrical quantity. In the electronic cigarette that needs to be charged, the user can charge the electronic cigarette in a timely manner. In disposable electronic cigarette, it's convenient for the user to replace the electronic cigarette in time.

In this embodiment, when the electronic cigarette is disposable, time required to consume an electrical quantity of the battery 8 and a capacity of tobacco liquid will be matched, that is, after the tobacco liquid is used up, the electrical quantity of the battery 8 is also completely consumed or only a little remains. To achieve this effect, a ratio between the capacity of the battery 8 (mA) and the capacity of the tobacco liquid (ml) can be controlled to be less than or equal to 200/1. Specifically, in one embodiment, the capacity of the battery 8 is 2000 mA, and the capacity of the tobacco liquid is 10 ml-20 ml.

Figure 4:
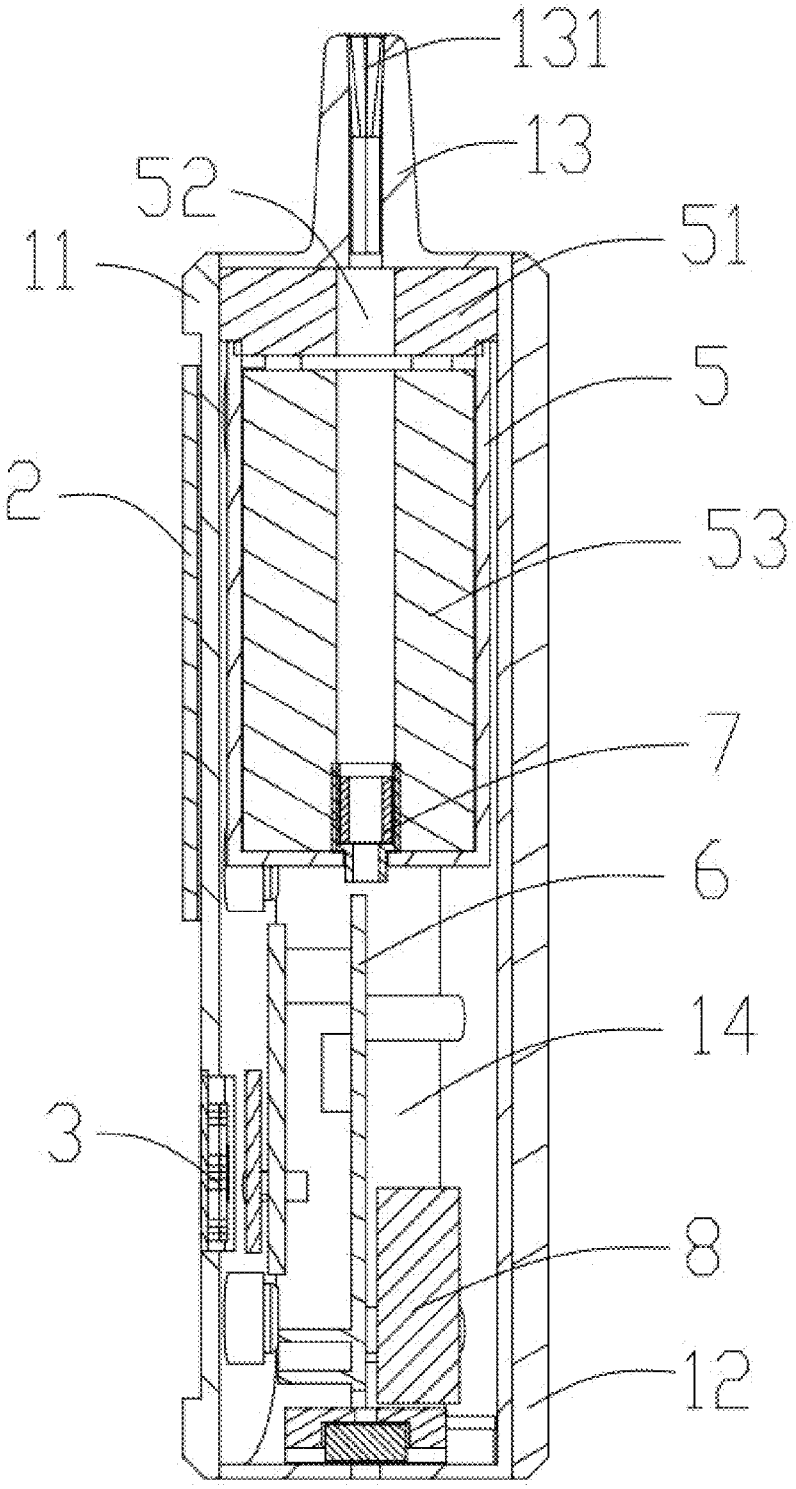
FIG. 4 is a cross-sectional view cutting along a middle of a mouthpiece according to the present invention.
Figure 5:
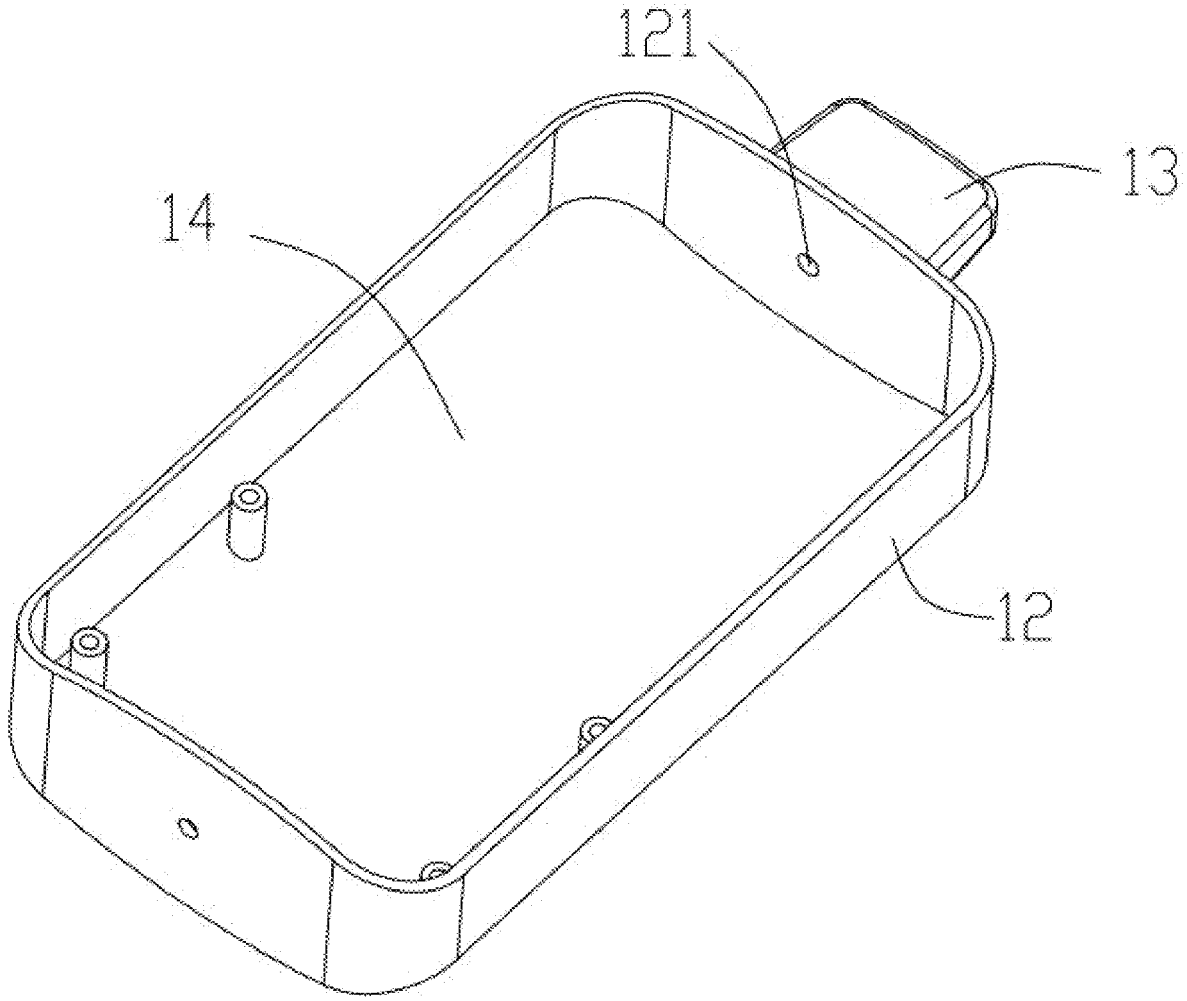
FIG. 5 is a structural diagram of a bottom shell according to the present invention.

In the above embodiments, referring to FIG. 2 and FIG. 4, the electronic cigarette further includes a circuit board 6 arranged within the main body 1. The control module 60 is integrated on the circuit board 6. The circuit board 6 is located below the storage bin 5. The battery 8 is located on one side of the circuit board 6 away from the display 3. Therefore, the storage bin 5, the battery 8, the circuit board 6, the display 3, and the atomizers 7 are distributed reasonably, and a volume of the electronic cigarette is reduced.

In one embodiment, referring to FIG. 6, the reminder module 10 is provided inside the main body 1, and the control module 60 is configured for driving the reminder module 10 when an electrical quantity of the battery 8 is low, the functional module 30 is switched, power output by the driving modules 32 to the atomizers 7 is adjusted, or a lighting effect of the lighting module 31 is switched, so as to let the user understand a state to which the electronic cigarette's function is switched by operating the movable part 2, or to let the user know the electrical quantity of the battery 8, thereby facilitating the user to use the electric cigarette.

Specifically, in one embodiment, referring to FIG. 2, the reminder module 10 includes an audio module 102. The audio module 102 includes a speaker 63 electrically connected to the control module 60. The audio module 102 is located inside the main body 1 and on a side of the circuit board 6 away from the battery 8, so that when a function of the electronic cigarette is switched by operating the movable part 2, the speaker plays a voice to allow the user to clearly understand the state of the electronic cigarette at this time.

In one embodiment, referring to FIG. 2 and FIG. 6, the reminder module 10 includes a vibration module 101. The vibration module 101 includes a vibration motor 62 electrically connected to the control module 60. The vibration motor 62 is located inside the main body 1 and on one side of the circuit board 6 away from the battery 8. When the user switches functions, the control module 60 is capable of driving the vibration motor 62 to vibrate to remind the user of successful function switching.

In one embodiment, referring to FIG. 2, the reminder module 10 can also be the lighting module 31. When the user switches functions, the control module 60 can drive the lighting module 31 and can also remind the user of successful function switching. A structure of the reminder module 10 is not limited here.

In practical application, switching a working mode of the reminder module 10 can be achieved by adjusting a vibration intensity and a frequency of the vibration module 1, such as brief and frequent vibrations or continuous vibrations for a preset time. Switching the working mode of the reminder module 10 can also be achieved by switching different audio and tones of the audio module 102, adjusting a size of audio playback, and switching lighting effects, etc.

In one embodiment, referring to FIG. 4, oil absorbing cotton 53 is provided in storage bin 5 for storing tobacco liquid. By storing tobacco liquid through the oil absorbing cotton 53, a risk of oil leakage can be reduced.

In the above embodiments, referring to FIGS. 2-5, the electronic cigarette further includes a mouthpiece 13 located at a top of the main body 1. A smoke outlet hole 121 in communication with an interior is provided at the top of the main body 1, and the mouthpiece 13 is equipped with a smoke guiding hole 131 in communication with the smoke outlet hole 121. An opening 50 is defined at a top of the storage bin 5, and a sealant member 51 is provided between the top of the storage bin 5 and an internal top surface of the main body 1. A through hole 52 is provided on the sealant member 51, and the through hole 52 is in communication with the storage bin 5 and the smoke outlet hole 121. Therefore, when the user smokes, the atomizers 7 can sequentially discharge the smoke generated by atomizing the tobacco liquid through the through hole 52, the smoke outlet hole 121, and the smoke guiding hole 131. The opening of the storage bin 5 can be sealed with the sealant member 51 to prevent oil leakage.

In the above embodiments, in order to facilitate production and manufacturing of the electronic cigarette in this embodiment, the main body 1 includes a bottom shell 12 equipped with a cavity 14 and a front shell 11 connected to the bottom shell 12 to form a cavity 14. The circuit board 6, the battery 8, the storage bin 5, the sealant member 51, the atomizers 7, and the display 3 are all arranged inside the cavity 14. The mouthpiece 13 is located on the bottom shell 12.

Figure 3:
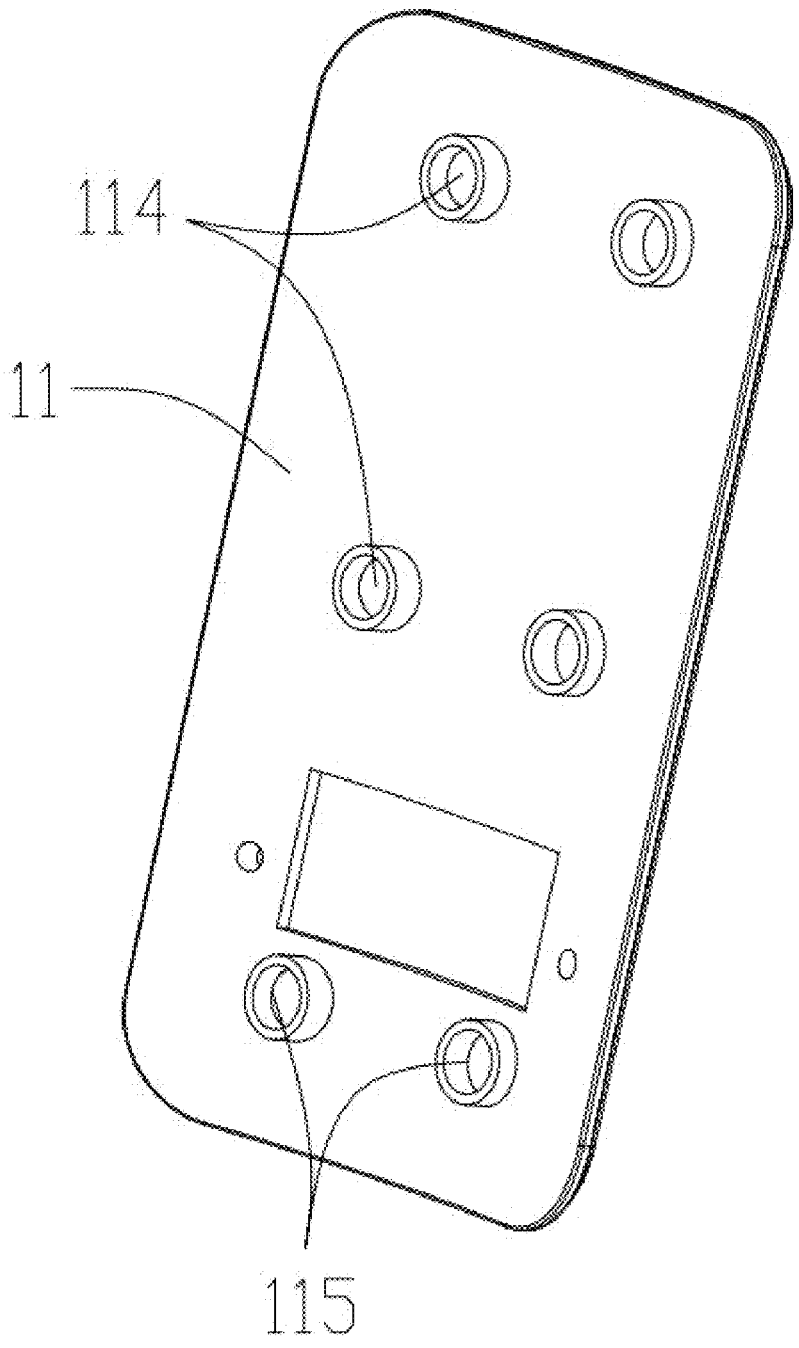
FIG. 3 is a structural diagram of a front shell according to the present invention.

In one embodiment, referring to FIG. 3, the first magnets 21 are embedded on one side of the movable part 2 near the cavity 14, and one side of the front shell 11 near the cavity 14 forms first embedding slots 115 and second embedding slots 114. The second magnets 113 are placed in the first embedding slots 115, and the third magnets 112 are placed in the second embedding slots 114, so as to fix the first magnets 21, the second magnets 113, and the third magnets 112. Specifically, the first magnets 21 can be integrated with the movable part 2 by injection molding or fixed to the movable part 2 through glue, interference fit, etc. The second magnets 113 and the third magnets 112 can be integrated with the front shell 11 by injection molding or fixed to the front shell 11 through glue, interference fit, etc.

Referring to FIGS. 2-3, in order to improve aesthetics of the electronic cigarette in this embodiment, a sliding groove 111 is provided on one side of the front shell 11 away from the cavity 14, the display 3 is located on the sliding groove 111, and the movable part 2 is placed inside the sliding groove 111, so as to make a surface of the movable part 2 together with a surface of the front shell 11 form a smooth plane.

In one embodiment, the lighting module 31 includes light emitting elements 4. The light emitting elements 4 are provided on the circuit board 6 and are electrically connected to the control module 60, so that when the user operates the movable part 2 to switch functions or when the user smokes, the control module 60 drives the light emitting elements 4 to emit light. Specifically, the light emitting elements 4 can be tricolor lamps to meet the user's demand for color. A total number of the light emitting elements 4 can be two, and the light emitting elements 4 are located on both sides of the display 3. Of course, in other embodiments, the total number of the light emitting elements 4 can also be one, three, or four lamps, and the number of the light emitting elements 4 is not limited here.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. An electronic cigarette comprising:

a main body;

a control module provided on the main body;

atomizers electrically connected to the control module;

a functional module electrically connected to the control module, wherein the functional module comprises at least one of a lighting module, driving modules and a reminder module, the lighting module, the driving modules and the reminder module are all electrically connected to the control module; wherein the atomizers are electrically connected to the control module through the driving modules;

a movable part being capable of sliding or rotating on the main body; and a sensing module electrically connected to the control module;

wherein the sensing module is used for feeding back a control signal to the control module when the movable part slides or rotates: according to the control signal fed back by the sensing module, the control module switches the functional module, adjusts power output by the driving modules to the atomizers, switches a lighting effect of the lighting module, or switches a working mode of the reminder module.

2. The electronic cigarette of claim 1, wherein the sensing module comprises first magnets, second magnets, and a Hall sensor: the first magnets are provided on the movable part, the second magnets are provided on the main body corresponding to or near a position of the Hall sensor, and the Hall sensor is electrically connected to the control module: the first magnets move when the movable part slides, and when the first magnets move to the position opposite to the second magnets, the first magnets cooperate with the second magnets to generate a magnetic field: the Hall sensor conducts under an action of the magnetic field and feeds back the control signal to the control module.

3. The electronic cigarette of claim 2, wherein a total number of the first magnets is multiple, and at least two first magnets are arranged along a lengthwise direction of the main body, and the main body is further provided with a plurality of third magnets: at least one of the first magnets is attracted with the second magnets when the movable part is close to the Hall sensor, and at least one of the first magnets is attracted with the third magnets when the movable part is away from the Hall sensor.

4. The electronic cigarette of claim 3, wherein the movable part has substantially rectangular plate shape, the total number of the first magnets is four, and the first magnets are arranged at four end corners of the movable part;

a total number of the second magnets is two, and the two second magnets are respectively located on both sides of the Hall sensor and are close to the Hall sensor; the two first magnets adjacent to the Hall sensor are respectively attracted with the two second magnets when the movable part is close to the Hall sensor;

a total number of the third magnets is four, and the third magnets are arranged in a same distribution manner as the four first magnets and are all located above the second magnets: the four first magnets are respectively attracted with the four third magnets when the movable part is away from the Hall sensor.

5. The electronic cigarette of claim 1, wherein the electronic cigarette further comprises a storage bin provided within the main body for storing tobacco liquid, and the atomizers are provided at a bottom of the storage bin.

6. The electronic cigarette of claim 5, wherein a total number of the atomizers is two, and the two atomizers are spaced apart: the total number of the driving modules is two, and each driving module is connected to a corresponding atomizer.

7. The electronic cigarette of claim 6, wherein the control module is used for stopping outputting power to one atomizer when the atomizer is driven to work for more than a preset time, and simultaneously driving another atomizer to work.

8. The electronic cigarette of claim 6, wherein the control module is further used for driving two atomizers to work simultaneously.

9. The electronic cigarette of claim 1, wherein the electronic cigarette further comprises a battery located within the main body, and the battery is electrically connected to the control module and used for supplying power to the control module.

10. The electronic cigarette of claim 9, wherein a ratio between a capacity of the battery and the capacity of the tobacco liquid is less than or equal to 200 mA/1 ml.

11. The electronic cigarette of claim 10, wherein the battery is a disposable battery or a rechargeable battery.

12. The electronic cigarette of claim 9, wherein the electronic cigarette further comprises a display arranged on the main body and electrically connected to the control module: the display is used for displaying at least one of an electrical quantity of the battery and a state of the functional module, and the display is located below the storage bin.

13. The electronic cigarette of claim 12, wherein the electronic cigarette further comprises a circuit board arranged within the main body: the control module is integrated on the circuit board, the circuit board is located below the storage bin, and the battery is located on a side of the circuit board away from the display.

14. The electronic cigarette of claim 13, wherein the reminder module is located within the main body, and the control module is configured for driving the reminder module when an electrical quantity of the battery is low, the functional module is switched, power output by the driving modules to the atomizers is adjusted, or a lighting effect of the lighting module is switched.

15. The electronic cigarette of claim 14, wherein the reminder module comprises an audio module, the audio module comprises a speaker electrically connected to the control module, and the audio module is located inside the main body and on one side of the circuit board away from the battery.

16. The electronic cigarette of claim 14, wherein the reminder module comprises a vibration module, the vibration module comprises a vibration motor electrically connected to the control module, and the vibration motor is located inside the main body and on one side of the circuit board away from the battery.

17. The electronic cigarette of claim 14, wherein the storage bin is equipped with oil absorbing cotton for storing tobacco liquid.

18. The electronic cigarette of claim 14, wherein the electronic cigarette further comprises a mouthpiece located at a top of the main body; the top of the main body is provided with a smoke outlet hole in communication with an interior of the main body; a smoke guiding hole in communication with the smoke outlet hole is provided on the mouthpiece;

an opening is defined at a top of the storage bin, and a sealant member is provided between the top of the storage bin and an internal top surface of the main body: the sealant member is provided with a through hole, and the through hole is in communication with the storage bin and the smoke outlet hole.

19. The electronic cigarette of claim 18, wherein the main body comprises a bottom shell with a cavity and a front shell connected to the bottom shell to form the cavity; the circuit board, the battery, the storage bin, the sealant member, the atomizers, and the display are all arranged in the cavity, and the mouthpiece is located on the bottom shell;

the front shell is provided with first embedding slots and second embedding slots on one side near the cavity, the second magnets are placed in the first embedding slots, and the third magnets are placed in the second embedding slots;

the front shell is provided with a sliding groove on one side away from the cavity, the movable part is placed inside the sliding groove, and the first magnets are embedded in the movable part on one side close to the cavity.

20. The electronic cigarette of claim 19, wherein the lighting module comprises light emitting elements; the light emitting elements are arranged on the circuit board and electrically connected to the control module; a total number of the light emitting elements is two, and the light emitting elements are respectively located on both sides of the display.

* * * * *